United States Patent [19]

Hartnell

[11] 4,088,225

[45] May 9, 1978

[54] PACKAGE

[75] Inventor: Freeman H. Hartnell, Horseheads, N.Y.

[73] Assignee: Corning Glass Works, Corning, N.Y.

[21] Appl. No.: 831,959

[22] Filed: Sep. 9, 1977

[51] Int. Cl.[2] ..... B65D 85/42

[52] U.S. Cl. ..... 206/419; 206/45.19; 206/585; 229/39 B; 220/468

[58] Field of Search ..... 206/419, 418, 422, 426, 206/45.19, 45.18, 521, 585; 229/39 B, 14 C; 217/35, 53

[56] References Cited

U.S. PATENT DOCUMENTS

| | | | |
|---|---|---|---|
| 2,768,737 | 10/1956 | Callahan | 206/418 |
| 3,227,357 | 1/1966 | Knapp et al. | 229/39 B |
| 3,294,226 | 12/1966 | McFarland et al. | 229/14 C |
| 3,363,753 | 1/1968 | Taylor | 206/422 |
| 3,405,799 | 10/1968 | Weller et al. | 206/422 |
| 3,406,819 | 10/1968 | Brander | 206/422 |
| 3,596,830 | 8/1971 | McFarland | 206/422 |
| 3,910,411 | 10/1975 | Deeren | 206/422 |
| 3,955,675 | 5/1976 | Kurtz | 206/422 |
| 4,019,637 | 4/1977 | Kurtz | 206/418 |

FOREIGN PATENT DOCUMENTS

| | | | |
|---|---|---|---|
| 2,240,386 | 3/1974 | Germany | 206/419 |

*Primary Examiner*—William Price
*Assistant Examiner*—Bruce H. Bernstein
*Attorney, Agent, or Firm*—Burton R. Turner; Clarence R. Patty, Jr.

[57] ABSTRACT

A package or package assembly comprising a carton for holding a plurality of five funnel-neck portions for television picture tubes with one such tube portion resting on the bottom of the carton in a neck-up orientation and including a paperboard separator and support assembly for spacing and supporting the remaining four of the tube portions in the carton with the necks thereof extending generally horizontally past the neck of the first tube portion in a rotary arrangement substantially corresponding to that of the ends of the arms of a swastika.

4 Claims, 5 Drawing Figures

PACKAGE

BACKGROUND OF THE INVENTION

Historically, for shipment of a plurality of funnel-neck portions for television picture tubes, each such portion has been enclosed in a carton in a funnel-down position and with the neck thereof extending out of the upper end of the carton, and then another similarly enclosed tube portion was placed over the first portion so that the neck of such first portion extends partly upwardly through the opening of and into the funnel of such other tube portion, there being holes in the bottom of said cartons for receipt therethrough of the necks of the tube portions. Such an arrangement vertically eliminated a substantial amount of empty space in shipping carriers such as trucks, trailers, etc. but there remained a substantial amount of empty shipping space horizontally between the necks of a plurality of stacks of such tube portions such as described above and arranged side by side in a carrier such as also mentioned above. Accordingly, a package assembly such as disclosed in U.S. Pat. No. 3,910,411 was developed.

Although a package assembly such as disclosed in the above-mentioned patent can eliminate a substantial amount of empty shipping space, molded plastic separators such as shown in such patent are relatively expensive to manufacture and are, therefore, relatively high in cost as compared, for example, to a separator made of paperboard. Additionally, oftentimes the packer using a package assembly such as discussed above desires that said separators, due to said manufacturing costs thereof, be returned to him for reuse and, of course, a certain amount of return shipping expense for return of the separators must then be considered. Therefore, the package such as disclosed herein and using a low-cost and disposable paperboard separator and support assembly was developed.

SUMMARY OF THE INVENTION

The invention is believed to be adequately summarized in the foregoing abstract of the disclosure and, therefore, to prevent repetition or redundancy and for the sake of brevity to the extent possible, no further summary of the invention is believed necessary.

BRIEF DESCRIPTION OF THE DRAWINGS

In the drawings:

Similar reference characters refer to similar parts in each of the FIGS. of the drawings.

Referring to the drawings in detail, there is shown in FIGS. 1, 2 and 5 a completely loaded carton or container 10 in which five tube portions 11, 12, 13, 14 and 15 have been disposed. (FIG. 1). Carton 10 has a generally rectangular bottom and, in loading such carton, a first one of the tube portions (portion 11) is positioned therein with the seal edge of the funnel of such portion resting on said bottom generally at the center thereof as illustrated in FIG. 2, that is, with the neck of portion 11 extending vertically upward from the funnel of such portion as shown in FIG. 5. Carton 10 also includes sidewalls 18, 19, 20 and 21 which extend vertically from each of the edges of bottom 17 and which are of a selected height for purposes hereinafter discussed.

Figure 2:
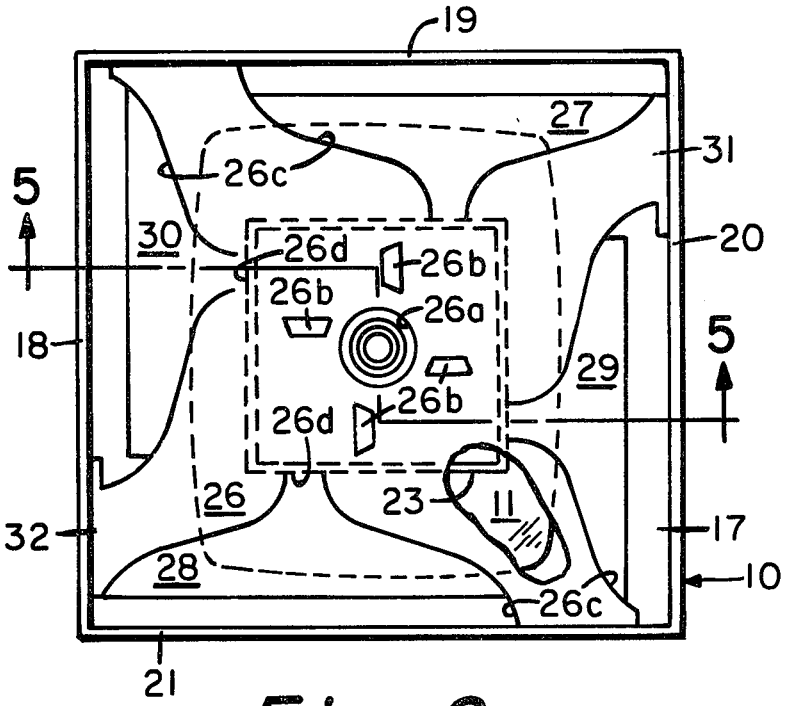
FIG. 2 is a top plan view similar to FIG. 1 but with only a selected one of the tube portions shown in the package.
Figure 4:
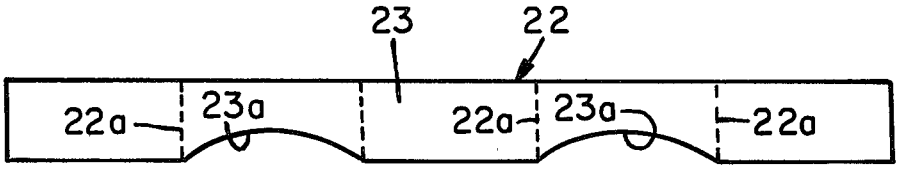
FIG. 4 comprises an elevational view, prior to folding thereof, of a vertical support and spacer member of the paperboard separator and support assembly of the invention.
Figure 5:
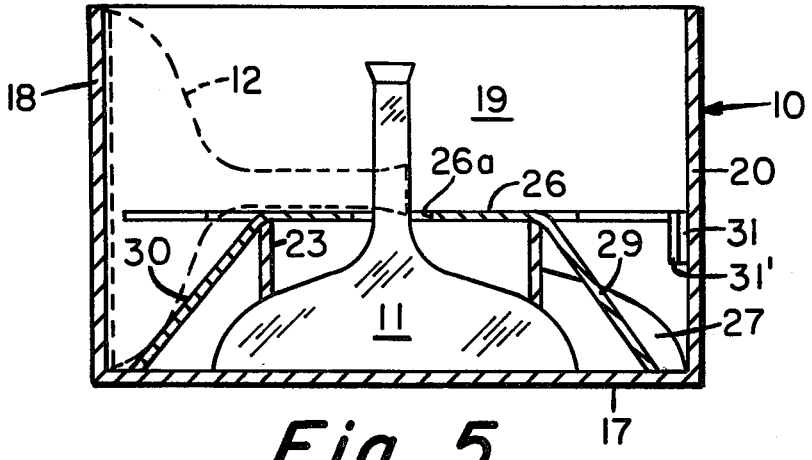
FIG. 5 is a cross-sectional elevational view of a package or package assembly in accordance with the invention and illustrating two tube portions contained therein.

Following the positioning of tube portion 11 in carton 10 as discussed above, a vertical support and spacer blank 22 (FIG. 4) is folded along its crease lines such as **22*a* to form a square vertical spacer member 23 including curved recesses such as 23*a* in two of opposite sides or panels thereof, and such spacer member is placed over the neck of tube portion 11 in a surrounding relationship therewith but with the four panels of the member spaced from the neck as illustrated in FIGS. 2 and 5. If considered necessary the end panels of blank spacer member 23 may be fastened to each other in any convenient manner such as by gummed tape for example. The centers of the cutouts or recesses such as 23*b* in spacer member 23 are shaped to rest on a selected area of the outer surface of tube portion 11 substantially in line with the major axis of the funnel of such tube portion while the straight lower edges of the remainder of the panels of blank 22 (spacer 23) rest on said selected area of the outer surface of tube portion 11 with the centers thereof in line with the minor axis of the funnel of tube portion 11. If it is believed desirable or expedient to do so for one reason or another, a spacer member having a cylindrical or other suitable configuration can be used in place of spacer member 23 as long as the lower edge thereof substantially conforms to the area of the outer surface of the funnel of a tube portion such as 11** upon which such lower edge rests.

Figure 3:
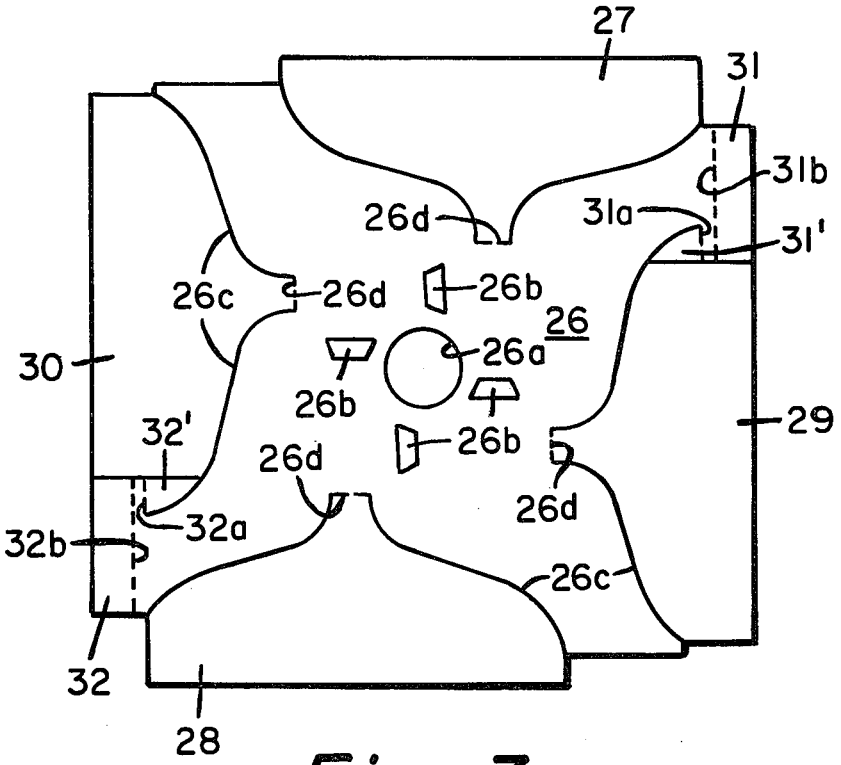
FIG. 3 is a top plan view of a planar separator and support member of the paperboard separator and support assembly of the invention.

There is provided a planar separator and support member such as 26 shown in FIG. 3 and having a generally rectangular perimetric configuration, except having a pair of opposite support panels such as 27 and 28 which extend slightly further out from the edges of member 26 than the remainder of such member which includes another pair of opposite support panels 29 and 30. Member 26 also embodies, in each of a pair of opposite corner areas thereof, a fold-down spacer-tab (tabs 31',31 and 32',32) for spacing part of the seal edge of the funnel part of a respectively adjacent tube portion from the side of said carton as discussed below. Tabs 31',31 and 32',32 each include a pair of cross-lines **31*a* and 31*b*, and 32*a* and 32*b*, respectively, for purposes hereinafter discussed. Member 26 further embodies a center hole 26*a* having a diameter slightly larger than the flare of the neck of a tube portion such as 11, and a plurality of four cut-outs such as 26*b* there being one such cut-out associated with each of the panels such as 27 through 30 and such cut-outs being generally equally spaced about the periphery of hole 26*a*. Each said cut-out such as 26*b* has the general configuration of a truncated triangle for receipt therein of part of the outer periphery of the flare of the neck of one of said tube portions as also discussed below. Panels 27 through 30 are provided, in planar member 26 by associated pairs of cut-lines such as 26*c*, each such pair extending from an associated edge of planar member 26 and curving inwardly towards each other from each respective edge to outline the configuration of part of the outer surface of a funnel of a tube portion. Thus, the planar member material between each pair of cut-lines provides a panel (such as 27 through 30) which is a push-down tube-support. There extends between the inner ends of each pair of cut-lines such as 26***c*, a crease-line such as 26*d* for hinging each respective panel for bending thereof downwardly as shown in FIGS. 2 and 5 and discussed hereinafter.

Following the previously described positioning of a vertical support and spacer member, such as 23, in a carton such as 10, the above discussed planar separator and support member 26 is disposed in the carton. To perform this action panels 27 through 30 are bent or hinged downwardly about their respective crease-lines such as 26*d* and the fold-down spacer-tabs 31',31 and 32',32 are folded downwardly about their respective pairs of crease-lines 31*a* and 31*b*, and 32*a* and 32*b*. Member 26 is then disposed in carton 10 in the position shown in FIGS. 2 and 5 and with the neck of tube portion 11 extending upwardly through hole 26*a* in member 26. Spacer tabs 31',31, at such time, are oriented as shown in FIG. 5. Spacer tabs 32',32 are, of course, similarly oriented.

Figure 1:
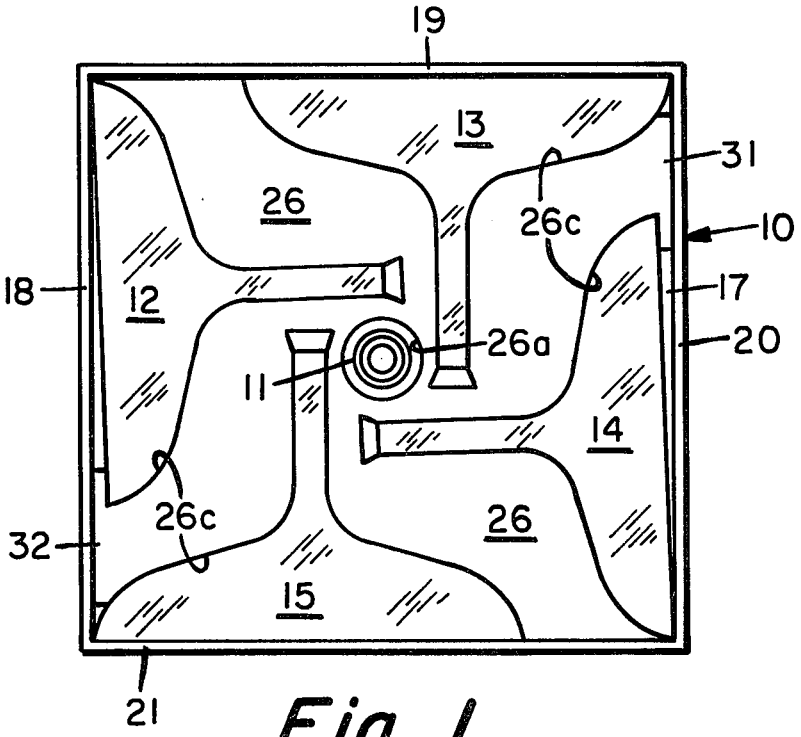
FIG. 1 is a top plan view of a package in accordance with the present invention and illustrating a plurality of five funnel-neck television tube portions contained in the package.

Carton 18 is now ready to receive four tube portions such as 12 through 15 which are oriented so that the minor axes of the funnels of such tube portions are horizontal and are then placed in the carton, as shown in FIG. 1, with the seal edges of the funnels of such four tube portions respectively disposed adjacent a different one of the sides such as 18 through 21 of the carton and with the necks of the tube portions extending horizontally past the neck of tube portion 11 in a rotary arrangement substantially corresponding or similar to the ends of the arms of a swastika. More specifically the seal edges of the funnels of tube portions 13 and 15 are in contact with their respectively associated carton sides 19 and 21 while the seal edges of the funnels of tube portions 12 and 14 contact their respective sides 18 and 20 only along one generally vertical side of each such seal edge due to the other generally vertical side of each such seal edge contacting the respectively associated one of the folded-down spacer-tabs 31',31 and 32',32. Thus, tube portions 12 and 14 are horizontally slightly tilted or slanted to allow the length of the sides 18 and 20 of carton 10 to be less than the length of the sides 19 and 21 of the carton while assuring clearance between the necks of tube portions 12 and 14 and the rims of the flares of the necks of tube portions 13 and 15, respectively. Such tilting of tube portions 12 and 14 also assures clearance between the flares of the necks of such tube portions and the neck of tube portion 11.

Such arrangement makes cartons such as 10 slightly rectangular rather than perfectly square but slightly reduces the overall size of such cartons for savings of shipping space. In other words, when a carton such as 10 is reduced in size in one direction and thereby made rectangular as mentioned, the neck flares of the necks of tube portions 12 and 14 would be too close for the neck of tube portion 11 and the necks of tube portions 12 and 14 would be too close to the rims of the flares of the necks of tube portions 13 and 15 if the aforesaid tilting of tube portions 12 and 14 was not provided. When the tube portions are positioned as described, the flares of the necks thereof enter the cut-outs such as 26*b* of member 26 and the top surface of such member is thus supporting the necks of the tube portions. The two cut-outs such as 26*b* which receive the flares of the necks of tube portions 12 and 14 are slightly tilted as compared with the other two of such cut-outs to allow for the aforesaid tilting of tube portions 12 and 14.

It is believed expedient to point out at this time that the sides 18 through 21 of carton 10 are of a height such that the uppermost parts of the boarders or rims of the seal edges of the funnels of tube portions 12 through 15 coincide with the upper edges of said sides when such tube portions are disposed in the carton as described above. (See FIG. 5 and tube portion 12 therein.) By such arrangement a top or lid of a cap or other suitable type may be placed over the upper end of carton 10 and such lid will be supported by tube portions 12 through 15 as well as by the sides of the carton. Therefore a stack of such loaded cartons may be formed by stacking the cartons one on top of another without the use of support posts or holding stiffeners. An additional economic savings is thus attained.

Although there is herein shown and described only one form of a package embodying the invention, it is to be understood that such is not to be considered in any way limiting but that various changes and modifications may be made therein within the purview of the appended claims without departing from the spirit and scope of the invention.

What is claimed is:

1. In combination with a carton or container for packaging a plurality of five funnel-neck portions for television picture tubes, such carton having a rectangular bottom with a sidewall extending vertically from each of the edges thereof and said tube portions to be positioned therein with the seal edge of the funnel of a first of such portions resting on said bottom of the carton generally at the center thereof and with the remaining four tube portions positioned about said first tube portion with the seal edge of the funnel of each of such four portions respectively disposed adjacent a different one of said sides of said carton, the necks of each of such four portions respectively extending generally horizontally past each of four points separated approximately ninety degrees about the periphery of the neck of said first tube portion and spaced from such portion, a paperboard separator and support assembly for said tube portions, such assembly comprising;

(A) a vertical support and spacer member including a lower edge conforming to and for resting on a selected area of the outer surface of the funnel of said first tube portion while surrounding the neck thereof and spaced from such neck; and, (B) a planar separator and support member for resting on the upper edge of said vertical support and spacer member, such planar member having a generally rectangular configuration for fitting inside said carton parallel with said bottom thereof and embodying, (I) a center hole for receipt therethrough of the neck of said first tube portion, (II) a pair of cut-lines extending from each edge of the planar member and generally curving inwardly towards each other from adjacent each respective edge to outline the configuration of part of the outer surface of a funnel of one of said four tube portions, the planar member material between each said pair of cut-lines providing a push-down tube portion support panel, (III) a crease-line extending between each said pair of cut-lines to provide for each respective said support panel a hinge means located so as to generally coincide with the funnel-neck junction of one of said four tube portions when the funnel part of such portion is disposed between the respective pair of cut-lines, and (IV) a cut-out associated with each said support panel, each such cut-out located adjacent said center hole so as to receive the flare of the neck of one of said four tube portions when the funnel part of such portion is disposed between the pair of cut-lines outlining the panel with which the respective cut-out is associated.

2. A paperboard separator and support assembly in accordance with claim 1 and in which said planar separator and support member further embodies, in a corner area thereof, a fold-down spacer-tab for spacing part of the seal edge of the funnel part of a respectively adjacent one of said four tube portions from the side of said carton to horizontally tilt the respective tube portion and assure clearance between the neck thereof and the rim of the flare of the neck of the tube portion immediately adjacent to the neck of such respective tube portion as well as between the flare of the latter neck and the neck of said first tube portion, and a similar fold-down spacer-tab in a diagonally opposite corner area of the separator and support member.

3. In a carton or container packaging a plurality of five funnel-neck portions for television picture tubes, such carton having a rectangular bottom with a side-wall extending vertically from each of the edges thereof and said tube portions positioned therein with the seal edge of the funnel of a first one of such portions resting on said bottom of the carton generally at the center thereof and with the remaining four tube portions positioned about said first tube portion with the seal edge of the funnel of each of such four portions respectively disposed adjacent a different one of said sides of said carton, the necks of each of such four portions respectively extending generally horizontally past each of four points separated approximately ninety degrees about the periphery of the neck of said first tube portion and spaced from such portion, the combination comprising, a paperboard separator and support assembly for said tube portions, such assembly including;

(A) a vertical support and spacer member including a lower edge conforming to and resting on a selected area of the outer surface of the funnel of said first tube portion while surrounding the neck thereof and spaced from such neck; and, (B) a planar separator and support member resting on the upper edge of said vertical support and spacer member, such planar member having a generally rectangular configuration fitting inside said carton parallel with said bottom thereof and embodying, (I) a center hole receiving therethrough the neck of said first tube portion, (II) a pair of cut-lines extending from each edge of the planar member curving inwardly towards each other and generally outlining the configuration of part of the outer surface of a funnel of one of said four tube portions resting between said cut-lines, the planar member material between each said pair of cut-lines being pushed down and providing a tube portion support panel, (III) a crease-line extending between each said pair of cut-lines and providing for each respective said support panel a hinge means located so as to generally coincide with the funnel-neck junction of one of said four tube portions having its funnel part disposed between the respective pair of cut-lines, and (IV) a cut-out associated with each said support panel, each such cut-out located adjacent said center hole and receiving the flare of the neck of the one of said four tube portions disposed between the pair of cut-lines outlining the panel with which the respective cut-out is associated.

4. A paperboard separator and support assembly in accordance with claim 3 and in which said planar separator and support member further embodies, in a corner area thereof, a fold-down spacer-tab spacing part of the seal edge of the funnel part of a respectively adjacent one of said four tube portions from the side of said carton and horizontally tilting the respective tube portion to assure clearance between the neck thereof and the rim of the flare of the neck of the tube portion immediately adjacent to the neck of such respective tube portion as well as between the flare of the latter neck and the neck of said first tube portion, and a similar fold-down spacer-tab in a diagonally opposite corner area of the separator and support member.

* * * * *